United States Patent [19]

Garvey

[11] Patent Number: 4,881,284

[45] Date of Patent: Nov. 21, 1989

[54] SELF-CLEANING RESTROOM

[75] Inventor: Glenwood L. Garvey, Los Angeles, Calif.

[73] Assignee: Self-Cleaning Environments, Inc., Santa Monica, Calif.

[21] Appl. No.: 260,936

[22] Filed: Oct. 21, 1988

[51] Int. Cl.[4] ..... A47K 4/00

[52] U.S. Cl. ..... 4/662; 4/663; 4/664; 134/168 R

[58] Field of Search ..... 4/662–663, 4/664, 661; 134/167 R, 168 R; 52/64, 65, 70, 71

[56] References Cited

U.S. PATENT DOCUMENTS

| | | | |
|---|---|---|---|
| 3,713,176 | 1/1973 | Stock | 4/662 |
| 3,720,961 | 3/1973 | Garvey | 4/662 |
| 3,837,176 | 9/1974 | McTighe et al. | 4/662 |
| 3,869,732 | 3/1975 | Garvey et al. | 4/662 |
| 4,428,085 | 1/1984 | Bateson | 4/662 |

*Primary Examiner*—Henry K. Artis

*Attorney, Agent, or Firm*—Fulwider, Patton, Lee & Utecht

[57] ABSTRACT

The self-cleaning restroom includes at least one non-rotatable wall portion associated with a fixed toilet and at least one rotatable wall portion supporting a restroom fixture such as a lavatory or a urinal. The rotatable portion is adapted to move between an open position in which the toilet and the fixture are accessible for use and a closed position in which all of the wall portions are nested in close proximity to each other to define a cleaning space for automatic cleaning of the self-cleaning restroom. Spray nozzles are provided for cleaning the walls, toilet, lavatory, urinal, and other accessories such as a mirror in the closed position with a fluid solution. One of the wall members is formed with its wall panels at right angles to form a single angle wall; and at least one other of the wall members has a zig-zag double angle configuration, recessed with respect to the one wall member. In one embodiment, the self-cleaning restroom is enclosed within a main housing wall, and the single angle wall member in combination with the double angle recessed wall member provide a utility space between the non-recessed wall member and the main housing wall. In another embodiment, the self-cleaning restroom is juxtaposed to at least one other like self-cleaning restroom, the define a utility space.

5 Claims, 11 Drawing Sheets

SELF-CLEANING RESTROOM

BACKGROUND OF THE INVENTION

1. Field of the Invention

This invention is directed to a self-cleaning restroon, and more specifically, the invention concerns a modular self-cleaning restroom having a partially recessed wall configuration.

2. Related Art

Self-cleaning restrooms of the type having walls which close into a nesting configuration to define a cleaning enclosure are known, for example, from my U.S. Pat. Nos. 3,869,732 and 3,720,961. The walls carry restroom fixtures into close proximity with each other when the walls are nested together, so that nozzles in the walls or near the fixtures which spray a cleaning solution will clean the walls and fixtures. In one form, a lavatory is rotated into juxtaposition with a fixed toilet, which has fixed plumbing lines, so that plumbing to the toilet need not be through rotating joints. The size and configuration of such self-cleaning restrooms generally need to be of a compact nature, for conservation of the cleaning solution and optimum efficiency of the available pressure to the spray nozzles. The compactness of such self-cleaning restrooms can be a drawback where the enclosures become cramped for adequate convenience for the handicapped; so that it is desirable to provide new and more efficient configurations for self-cleaning restrooms which are compact in a nested position for improved efficiency in the cleaning operation, and sufficiently spacious in an open position for convenient, comfortable use by the handicapped. The present invention fulfills this need.

SUMMARY OF THE INVENTION

The present invention provides for a self-cleaning restroom having at least one non-rotatable wall portion associated with a fixed toilet and at least one rotatable wall portion supporting a restroom fixture such as a lavatory or a urinal. The rotatable portion is adapted to move between an open position in which the toilet and the fixture are accessible for use and a closed position in which all of the wall portions are nested in close proximity to each other to define a cleaning space for automatic cleaning of the self-cleaning restroom. Spray nozzles are provided for cleaning the walls, toilet, lavatory, urinal, and other accessories such as a mirror, with a fluid solution. Panel segments are provided for carrying the lavatory or urinal on the rotatable wall portion; and rotation joints are provided in line with the hinges for rotating the plumbing along with the wall carrying the fixture support panel segments into the closed position. Stationary, non-rotatable plumbing lines are provided for fluid communication with the toilet; fixture plumbing lines are also provided for fluid communication with the fixture and for fluid communication with the stationary plumbing lines. The cleaning means include cleaning lines and rotation joints allowing rotation of at least a portion of the cleaning lines with the rotatable wall portion, with respect to the stationary plumbing lines. One of the wall members is formed with its wall panel segments at right angles to form a single angle wall; and at least one other of the wall members has a zig-zag double angle configuration, recessed with respect to the one wall member.

Briefly and in general terms, a self-cleaning restroom according to the present invention comprises at least one non-rotatable wall panel portion associated with a fixed toilet and at least one rotatable wall panel portion supporting a restroom fixture such as a lavatory or a urinal. The rotatable portion is adapted to move between an open position in which the toilet and the fixture are accessible for use, and a closed position in which all of the wall panel portions are nested in close proximity to each other to define a cleaning space for automatic cleaning of the self-cleaning restroom. One of the wall panel portions is preferably formed with its panel segments at right angles to form a single angle wall panel; and at least one other of the wall panel portions has a zig-zag double angle configuration, recessed with respect to the single-angle wall panel portion.

In a presently preferred embodiment, a second segment of the single angle wall panel portion has a length greater than the first segment of the single angle wall panel portion and the self-cleaning restroom cleaning space is reduced by the greater length extension of the single angle wall panel portion in the closed position. The self-cleaning restroom rotatable wall member preferably comprises a double angle wall panel which is hinged for rotation into nesting relationship with a single angle non-rotatable wall member.

In another currently preferred aspect of the invention, a single accommodation self-cleaning restroom is enclosed within a main housing wall, and the single wall member in combination with the double angle recessed wall member provide a utility space between the non-recessed wall member and the main housing wall. In an alternate, currently preferred embodiment of a multiple accommodation, the self-cleaning restroom is juxtaposed to at least one other like self-cleaning restroom, and the single angle wall panel member and the double angle recessed wall panel member define a utility space in combination with at least one other like self-cleaning restroom.

Other aspects and advantages of the invention invention will become apparent from the following detailed description, and the accompanying drawings illustrating by way of example the features of the invention.

DETAILED DESCRIPTION OF THE INVENTION

Figure 1:
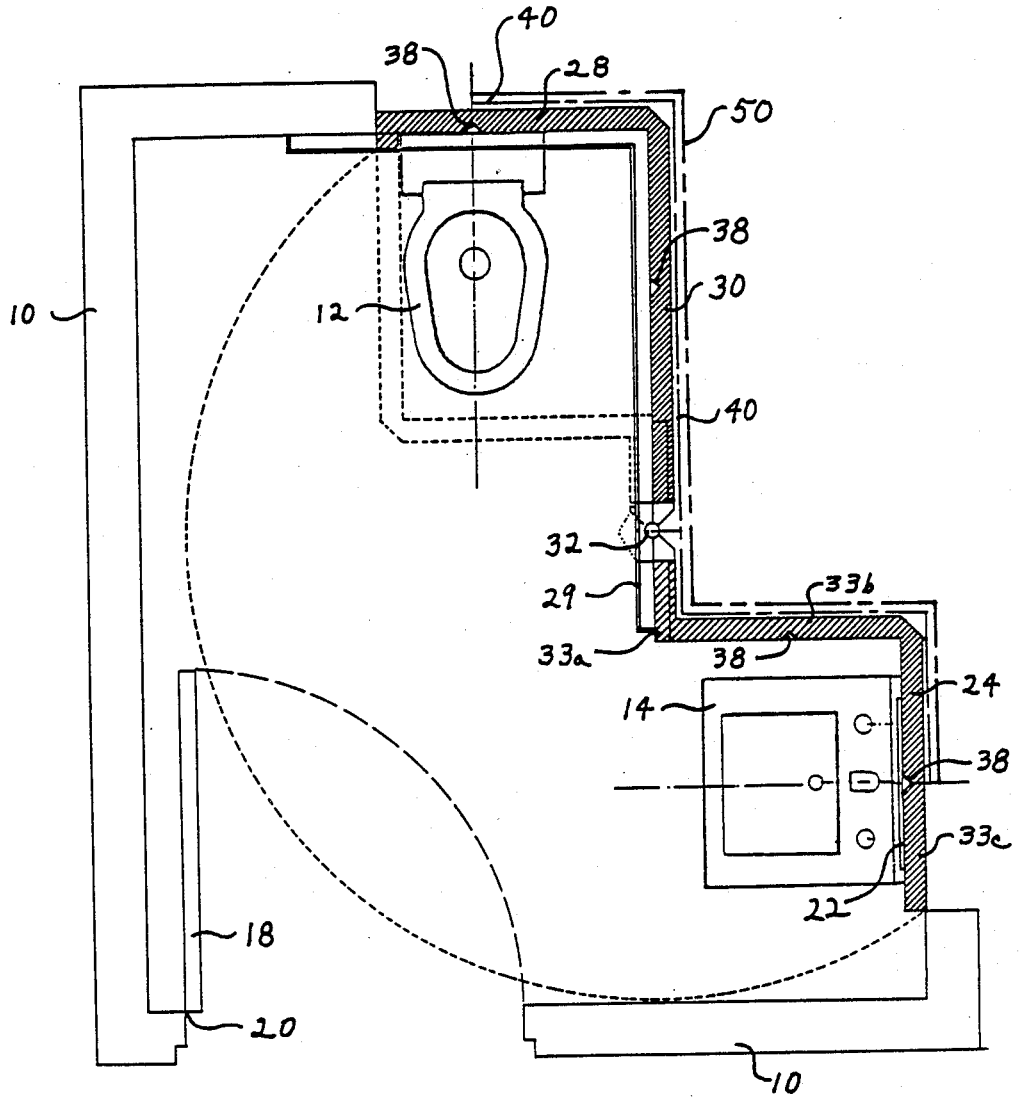
FIG. 1 is a top plan, schematic view of the restroom of the invention in its open position.

As is shown in the drawings for purposes of illustration, the invention is embodied in a self-cleaning restroom having at least one non-rotatable wall portion associated with a fixed toilet and at least one rotatable wall portion supporting a restroom fixture such as a lavatory or a urinal. The rotatable portion is adapted to move between an open position in which the toilet and the fixture are accessible for use and a closed position in which all of the wall portions are nested in close proximity to each other to define a cleaning space for automatic cleaning of the self-cleaning restroom. One of the wall members is formed with its wall panel segments at right angles to form a single angle wall; and at least one other of the wall members has a zig-zag, double angle configuration, recessed with respect to the one wall member. The single angle wall panel and the double angle wall panel combine together in a closed position in which the cleaning space within the folded wall panels of the restroom is reduced for more efficient cleaning. The single angle and double angle wall panels also provide for a utility space between the wall of the main enclosure of the restroom or between adjacent self-cleaning restroom units.

In accordance with the invention there is provided an improved self-cleaning restroom of the type having at least one non-rotatable wall member associated with a fixed toilet and at least one rotatable wall member supporting a restroom fixture and adapted to move between a first position in which the toilet and the fixture are accessible for use and a second position in which the wall members, the toilet and the fixture are nested in close proximity to each other to define a cleaning space for automatic cleaning; means for cleaning the walls, toilet and fixture in their second position with a fluid solution; restroom fixture support means carrying the fixture; means for rotating the fixture support means into the second position; stationary and non-rotatable plumbing means including stationary plumbing lines in fluid communication with the toilet; fixture plumbing means in fluid communication with the fixture and in fluid communication with the stationary plumbing means, including plumbing lines and means for rotating at least a portion of the plumbing lines and means for rotating at least a portion of the plumbing lines with respect to the stationary plumbing lines; and the cleaning means including cleaning lines and means for rotating at least a portion of the cleaning lines with the fixture support means with respect to the stationary plumbing lines, the improvement comprising one of the wall members having first and second wall sections formed at right angles to form a single angle wall; and at least one other of the wall members having a zig-zag double angle configuration, with first, second, and third wall sections, the second wall section being formed at a first right angle to the first wall section, and the third wall section being recessed with respect to the single angle wall member, being formed at a second right angle opposite to the first right angle.

As is shown in the drawings, the improved self-cleaning restroom of the invention is illustrated in schematic plan views, for purposes of exemplifying and illustrating the invention. The invention retains many of the features of the self-cleaning restroom described in U.S. Pat. No. 3,869,732 and the disclosure of that patent is incorporated by reference herein. The present invention provides a self-cleaning restroom having panels which rotate into a cleaning position in close proximity to a wall panel having an associated stationary toilet. In the closed, cleaning position of the restroom, a cleaning space is defined by the panels of substantially smaller volume than in the open position of the restroom. In the closed position of the restroom, spray nozzles supply cleaning fluid to clean the fixtures and walls of the restroom. The enclosing wall panels, together with the ceiling and floor of the main restroom enclosure define the open and closed volumes of the restroom. Seals are provided on the wall panels adjacent the ceiling and floor to help contain the cleaning fluid during the cleaning operation.

Figure 4:
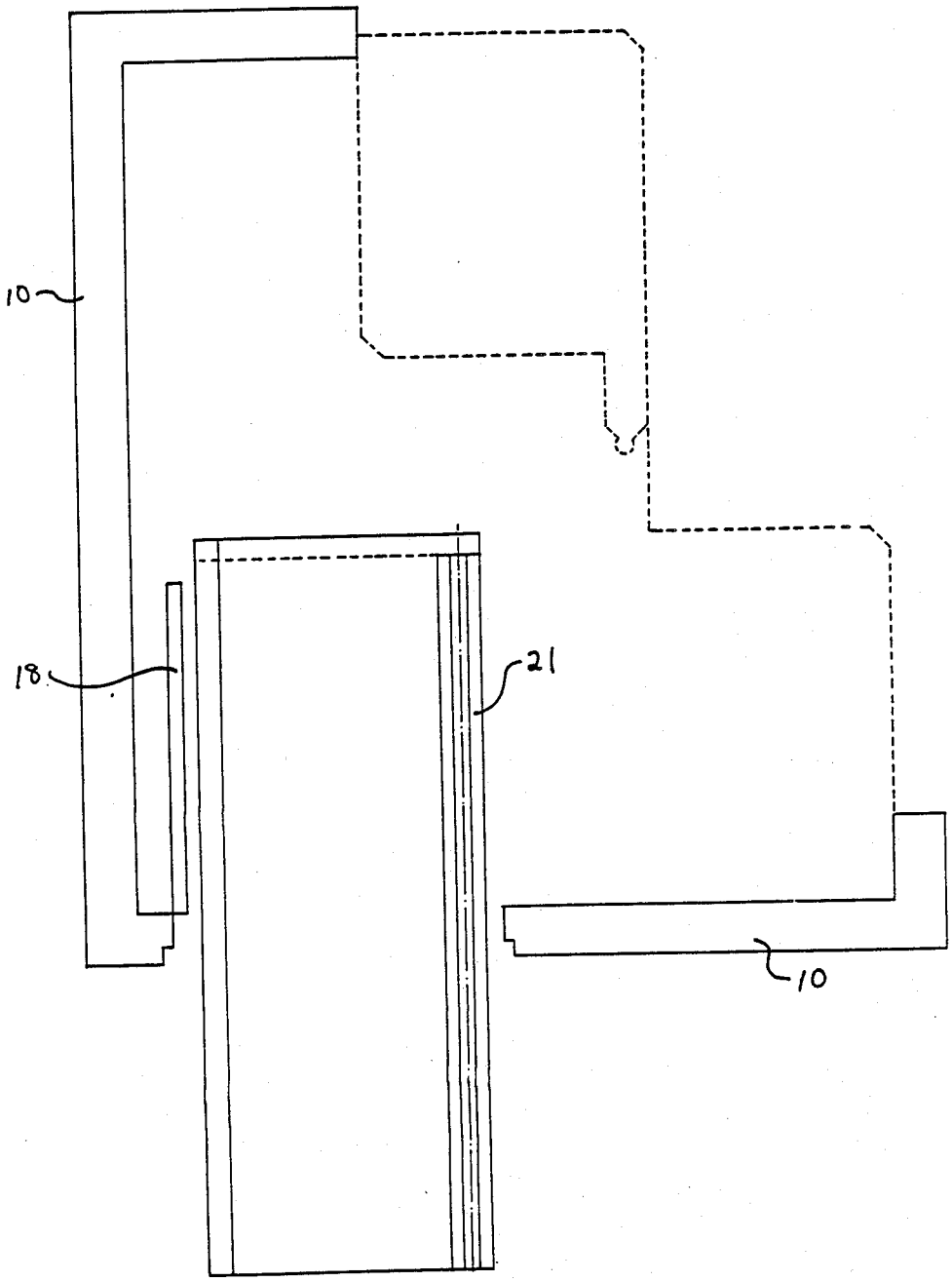
FIG. 4 is a top plan schematic view illustrating passage through a doorway of an existing room of the folded configuration of the restroom of FIG. 1.
Figure 8:
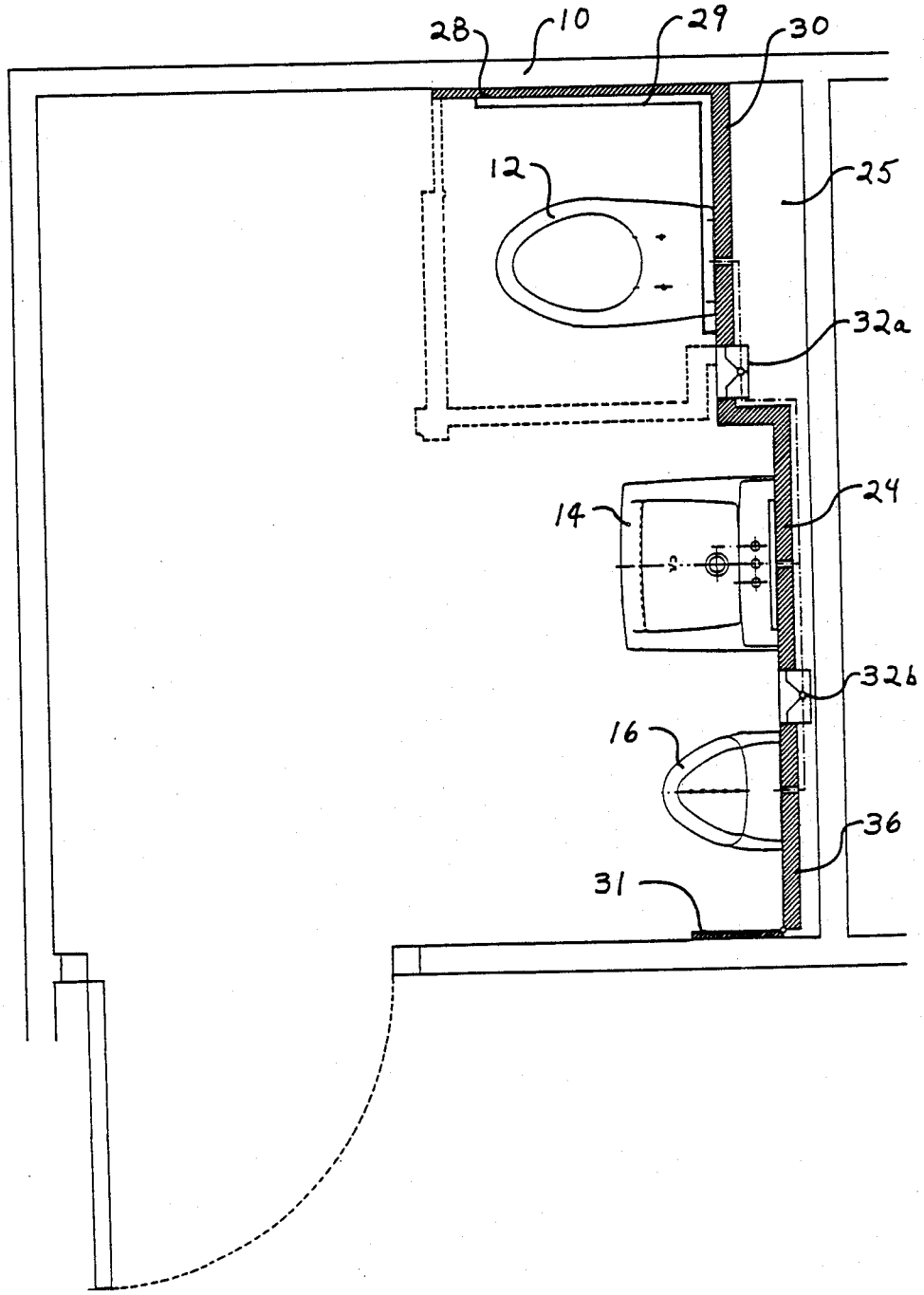
FIG. 8 is a top plan schematic view of an alternate embodiment of a self-cleaning restroom of the invention, including a lavatory and urinal wall panel, and also showing a third alternative utility space.

The main enclosure wall 10 of the single accommodation restroom defines the general enclosure space for the restroom facility. The restroom includes at least a stationary toilet 12, fixed in a position associated with the toilet wall panel 28, and at least one other restroom fixture such as the lavatory 14 and counter. In other embodiments such as is shown in FIG. 8, the restroom may include a urinal 16 as well. The restroom facility of the invention is more spaciously designed for convenient access of the handicapped, and includes a door 18 mounted by a hinge 20 to the wall of the enclosure to provide a sufficiently large entry way for wheelchairs. As is illustrated in FIG. 4, showing the outline 21 of the movement of the folded restroom through a doorway, the dimensions of the folded, closed configuration of the restroom are designed to be small enough to fit through the door of the room enclosure, a normal size door being large enough to accommodate the folded restroom.

The restroom may also include accessories such as a mirror 22, and a hand rail 29 which is useful for the handicapped, disabled, and elderly. As is shown in FIG. 1, the lavatory wall panel 24, supporting the lavatory sink and counter area, is mounted for rotation about a hinge 32, connecting the wall panels 30 and 24. The panel associated with the fixed toilet includes the fixed panel 28 and a second fixed panel 30 joined to the first fixed panel at right angles. In one currently preferred embodiment, the second fixed panel of the wall panel associated with the toilet has a greater length than the first, fixed panel, and extends to meet the hinge at the end of the rotatable panel 24, which is formed as a short section **33*a*, which is connected at right angles to a middle panel 33*b* at right angles to the short section 33*a*. The middle section 33*b* is joined to an end section 33*c* at right angles, forming a zig-zag configuration, and recessing the end panel 33*c*** supporting the lavatory fixture, relative to the fixed panels associated with the toilet.

Figure 2:
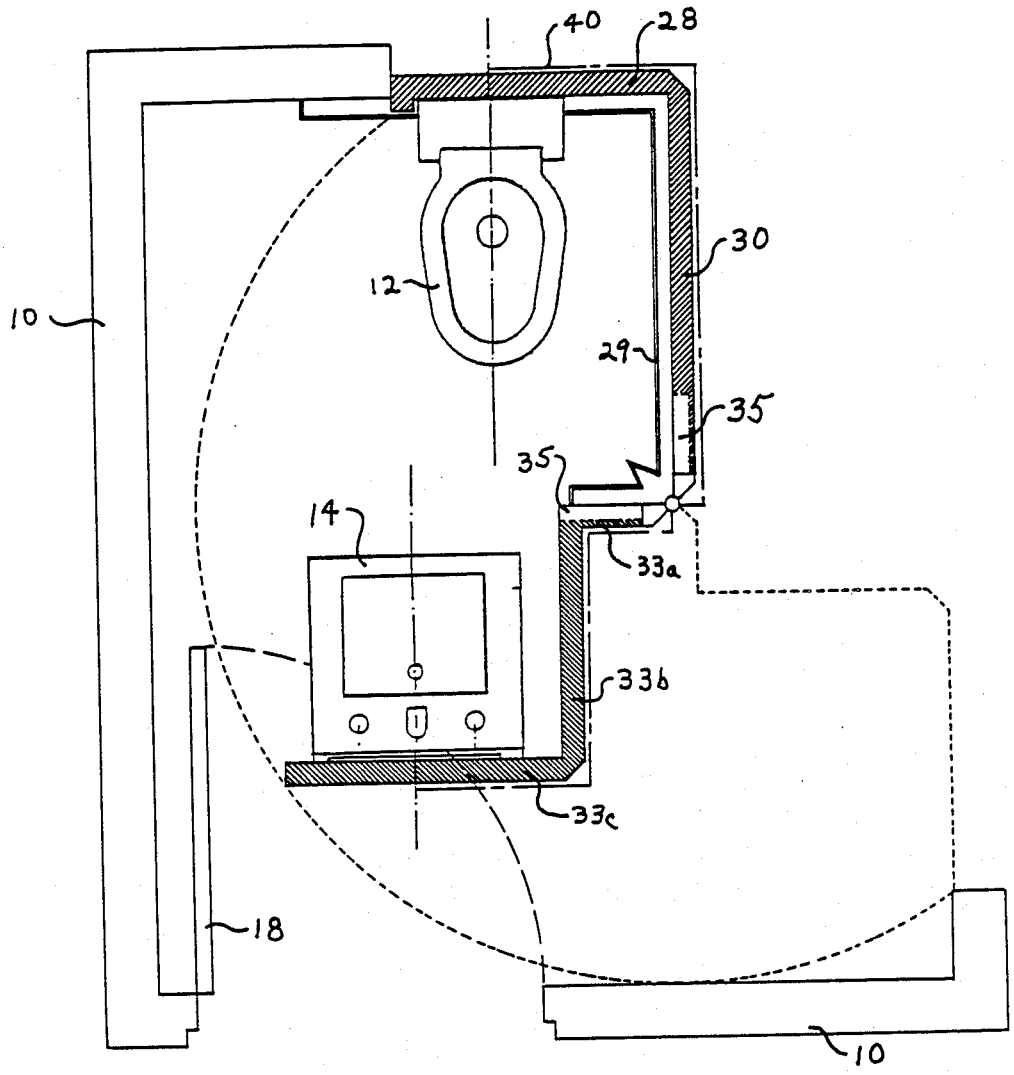
FIG. 2 is a top plan, schematic view of the restroom of FIG. 1 illustrating a partial rotation of the lavatory and lavatory panel in preparation for cleaning of the restroom.
Figure 3:
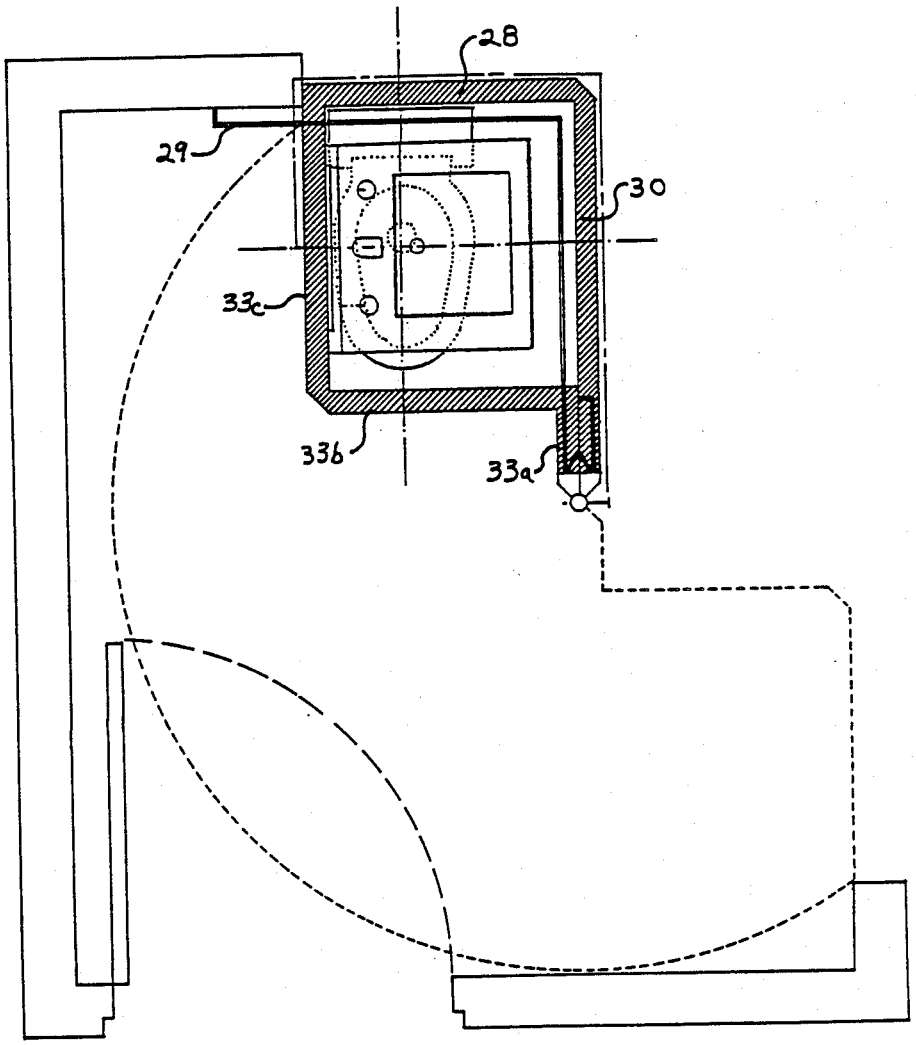
FIG. 3 is a top plan schematic view of the restroom of FIG. 1 illustrating the rotation of the lavatory panel and lavatory in a closed, cleaning position.
Figure 5:
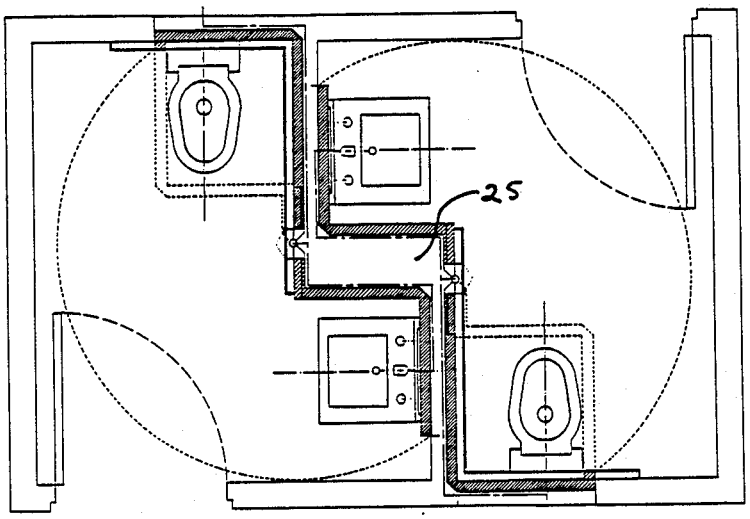
FIG. 5 is a top plan schematic view of a two unit restroom facility, illustrating the utility space.
Figure 6:
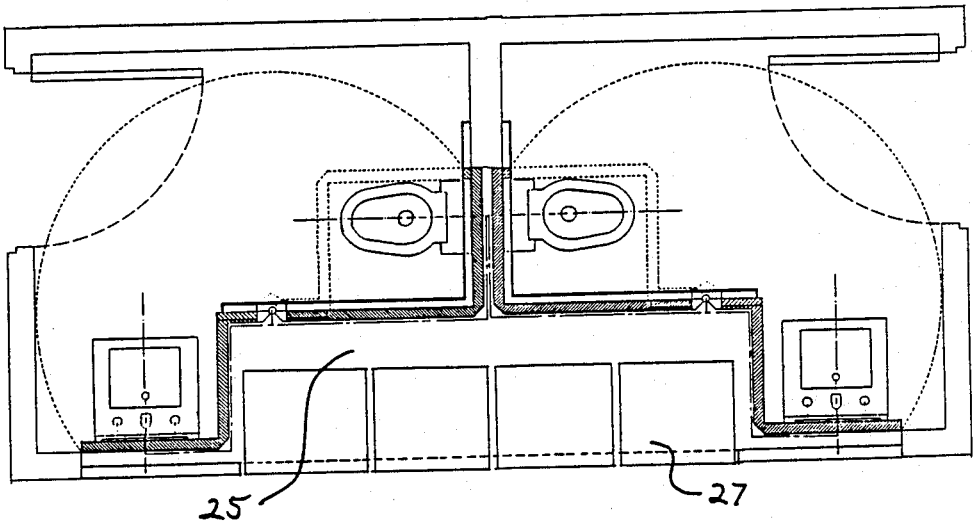
FIG. 6 is a top plan schematic view of an alternate configuration of a two unit facility with an alternate utility space.
Figure 7:
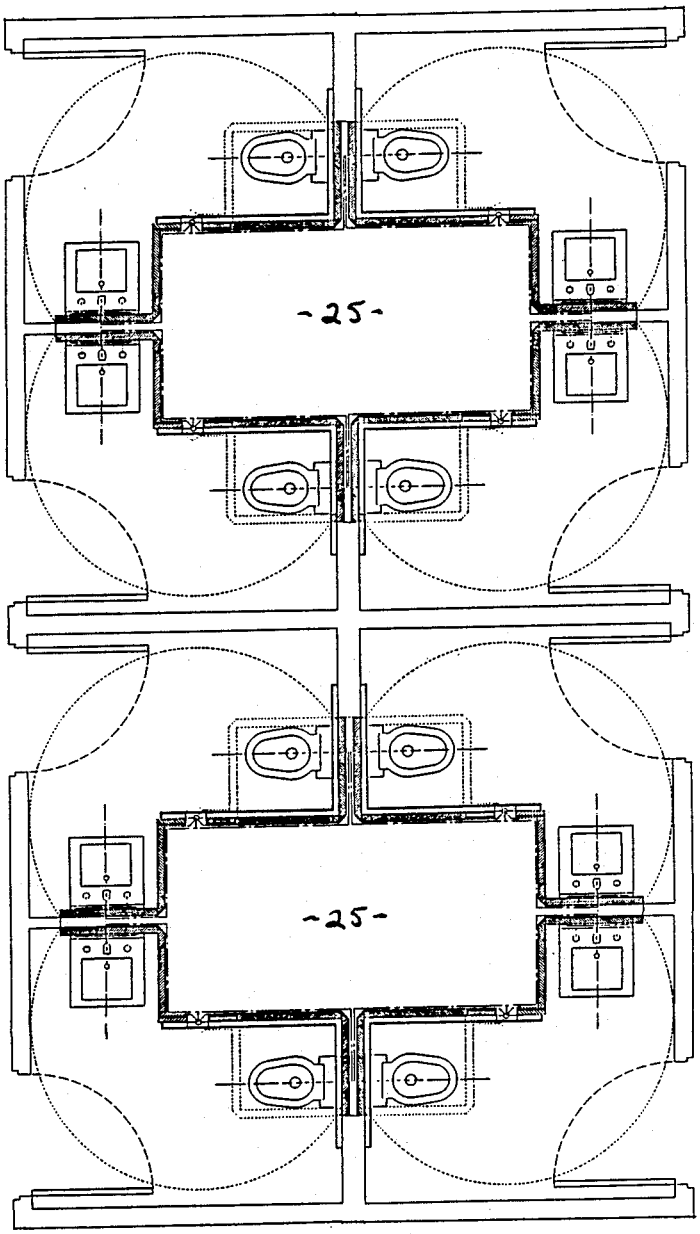
FIG. 7 is a top plan schematic view of self-cleaning restrooms according to the invention configured in four and eight unit facilities, showing a second alternative utility space.

The recessed configuration of the double angle while panel member has multiple advantages. As is illustrated in FIGS. 1, 2 and 3, the rotation of the double angle rotatable wall panel member into a closed, cleaning position, brings the lavatory fixture mounted thereon in close proximity to the toilet. However, the length of the first short piece 33*a* of the rotatable wall member corresponds to the extra length of panel 30 beyond that of panel 28 of the fixed panel member, causing the configuration of the restroom in its open position to change from one of an extended, open position spaciously lengthened by this distance, to one shortened by this distance in the closed, cleaning position. As is illustrated in FIG. 1, the large area behind the second fixed wall panel 30 can form a utility space. Referring to FIG. 5, combining two single restroom units to provide a double accommodation still provides a storage or utility space 25 behind the middle panel members of the rotatable wall panels. The arrangement of FIG. 6 allows sufficient room in the utility space 25 for storage cabinets 27, or other useful accessories. As is illustrated in FIGS. 2 and 3 the hand rail 29 is also jointed near the hinge 32, and as is shown in FIG. 2 the wall panel members include recesses 35 for receiving the portion of the hand rail which is enfolded near the hinges.

As is illustrated in FIGS. 1–3, rotation of the lavatory fixture of the rotatable wall panel member through 180° about the hinge 32, together with the cleaning nozzles 38 mounted in panels 24 and 28, requires that plumbing lines for the lavatory and/or urinal and for the cleaning nozzles on the panel wall member, must also rotate. Service plumbing lines are illustrated by dashed lines in FIGS. 1–11. The cleaning and service plumbing lines to the rotating wall panel and plumbing fixture rotate along the center line of the hinge 32, and are connected for rotation at a rotational joint. Service and cleaning plumbing lines associated with additional rotatable wall panels and associated fixtures also rotate along the center line of the hinges for those panels, in a similar fashion, as is shown in FIGS. 8–11.

Figure 12:
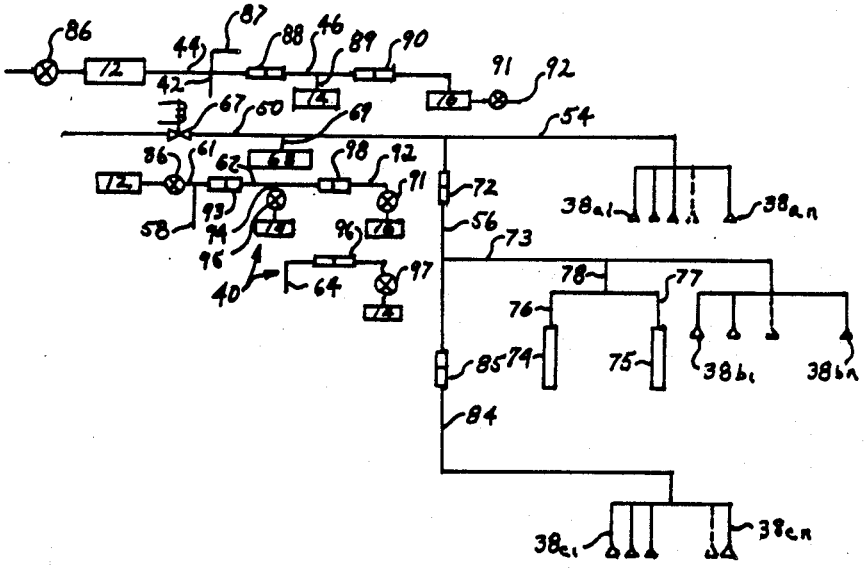
FIG. 12 is a line schematic illustrating waste lines and cleaning plumbing lines for the restroom.

FIG. 12 schematically illustrates a typical arrangement for service lines and cleaning plumbing lines for the self-cleaning restroom of the invention. Cleaning spray nozzles 38 are distributed along the wall panels and around the fixtures, and are supplied with cleaning solution as are the toilet and restroom fixtures. The service plumbing lines include a waste line 42 extending from a fitting 43, which is fixed and does not rotate. Waste line 44 in the panel 28 is in fluid communication with the fitting from the toilet. By making the toilet stationary, its waste line is also stationary, avoiding the necessity for an additional large, expensive rotation joint at this location. A waste line 46 extends from the lavatory 14, and where applicable, also extends from a urinal, into a rotatable segment of a rotation joint 90. Rotation joints are well known, and are described in U.S. Pat. No. 3,869,732. As mentioned earlier, the rotation joints are provided in line with hinges of the wall panels, to provide for rotation of the plumbing and service lines at the rotatable panels both between open and closed positions.

A separate fluid circuit is provided for the cleaning solution. A source of cleaning solution 68 is in fluid communication with the main cleaning solution line 50. The cleaning solution line 54 is connected to the main line 50, for communicating the cleaning solution and water to the fixed panels 28 and 30 and to the rotatable wall panels segments. Cold water flush line 61 extends from a cold water line 58 from a source of cold water to a rotation joint 93, from which a cold water line 62 extends into the fixed panel 24 in a fashion similar to that for the cleaning and waste lines in the panel. A hot water line 64 also extends into a non-rotatable segment 65 of an additional rotation joint 96, and hot water lines are in communication through this rotation joint.

As is illustrated in FIG. 12, a solenoid operated valve 67 operates to control flow through the cleaning solution line 50 and through the branch line 69, the solution being drawn from the source by reduced pressure in line 50 due to flow through the line. It should also be noted that a branch line 73, extending from a rotation joint 72 placed along the center line of hinge 32, supplies cleaning solution to extendable nozzles 74 and 75 mounted under the lavatory and counter area. Such extendable nozzles are commercially availale, and generally consists of telescopic segments which are extended against the force of a spring by pressure of cleaning solution through the nozzles.

Figure 9:
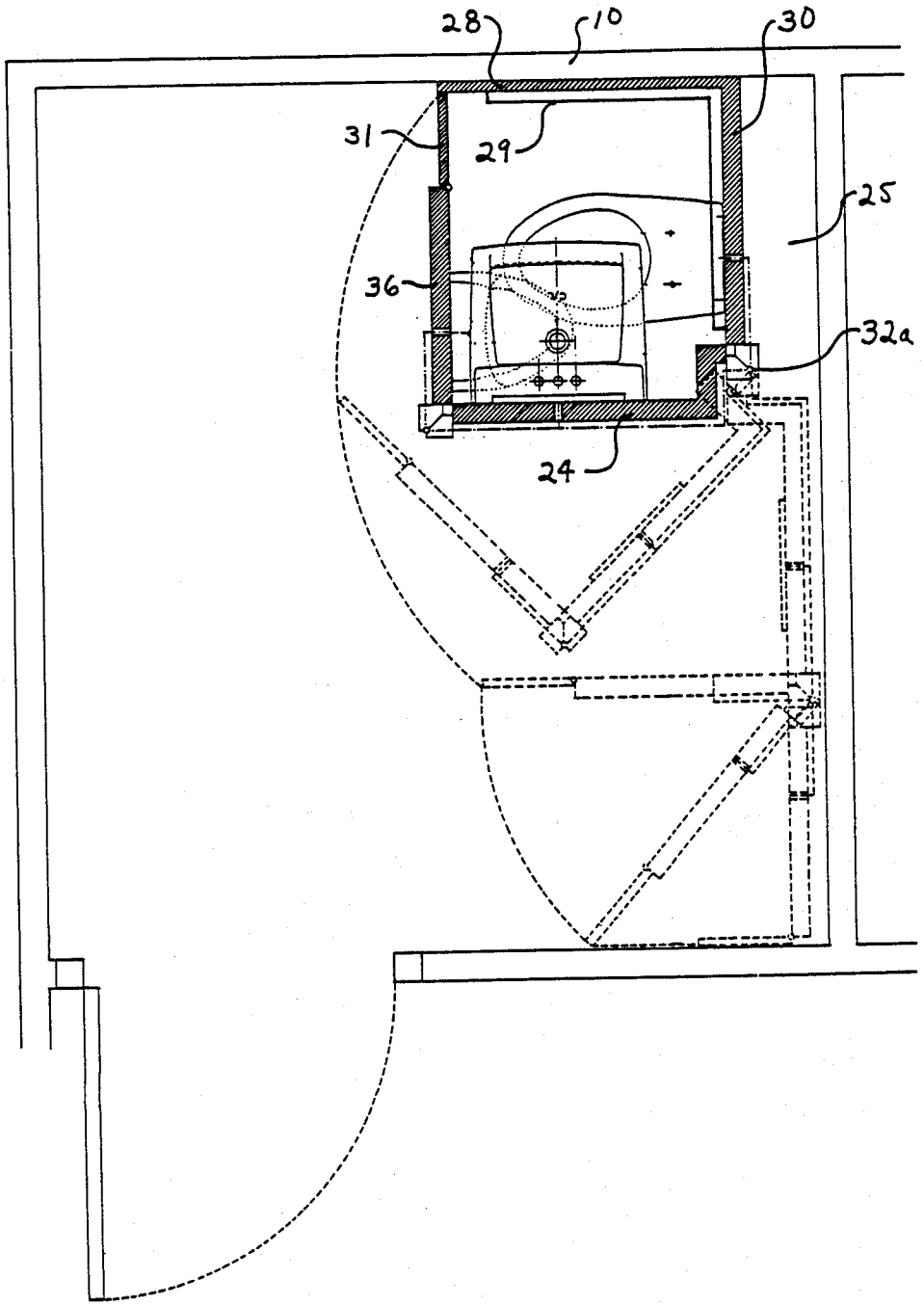
FIG. 9 is a top plan schematic view of the restroom of FIG. 8, showing the partial stages of closing and the final closed, cleaning position.

As is illustrated in FIGS. 8–11, an alternative embodiment of the invention includes an additional rotatable segment 36 of the rotatable wall panel 24, which may include an additional fixture, such as the urinal 16. The hinges 32*a* and 32*b* are each adapted for a rotation through a 90° angle, so that the combined rotation of the two rotating segments of the rotatable panel close the restroom area in a cleaning position, as is illustrated in FIGS. 8 and 9.

Figure 10:
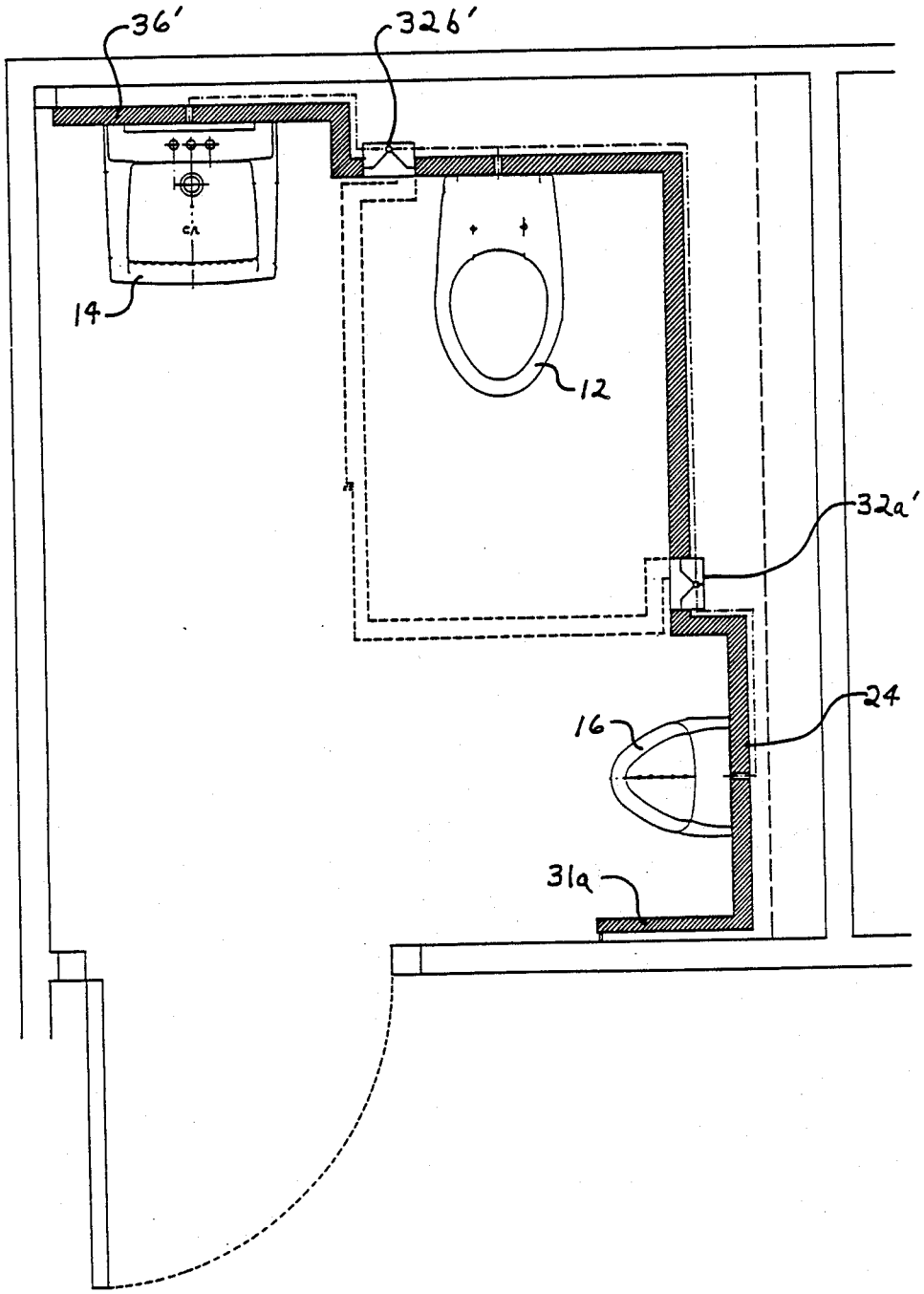
FIG. 10 is a top plan schematic view of a second alternative design of the self-cleaning restroom of the invention.
Figure 11:
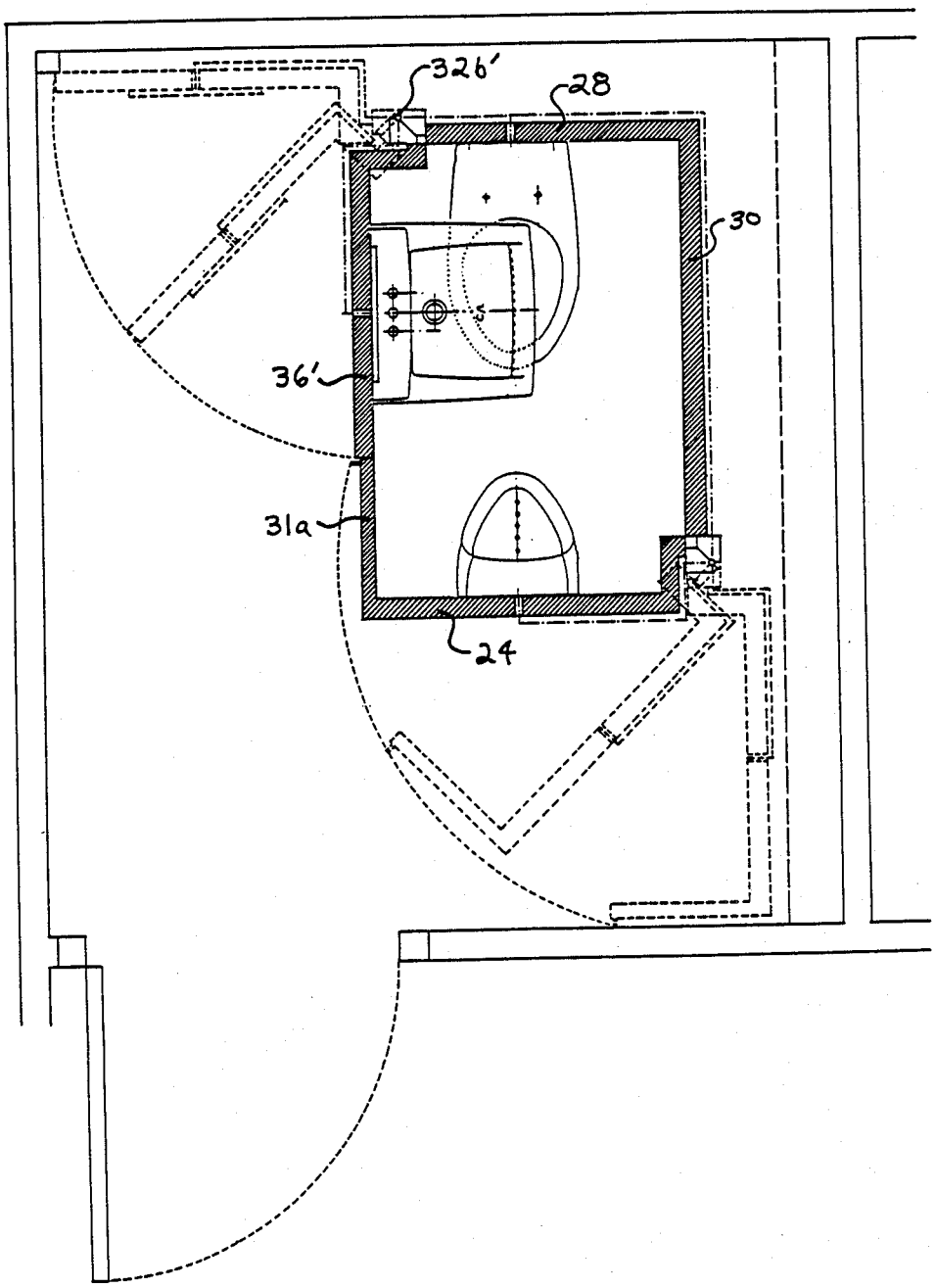
FIG. 11 is a top plan schematic view of the restroom of FIG. 10, showing the partial stages of closing and the final closed, cleaning position.

A third embodiment of the invention designed to cover two walls of a room is illustrated in FIGS. 10 and 11, showing two rotatable segments with hinges 32*a*′ and 32*b*′ mounted for rotation through a 90° angle for closing of the restroom area in a cleaning position. In this configuration, the rotatable wall panel 24′ carries a urinal, and includes a fixed panel segment 31*a* extending at 90° from the third segment of the rotatable wall panel, and a second rotatable wall panel 36′ is connected with the hinge 32*b*′ to the other side of the fixed wall panel for rotation to close the restroom facility in cleaning position. The arrangement of the cleaning and service plumbing lines is similar to that of the previously described embodiments.

From the foregoing, it will be appreciated that the self-cleaning restroom of the invention provides for more efficient configurations which are compact in nested positions of the wall panels, for improved cleaning and conservation of cleaning fluid, and yet which are sufficiently spacious in an open position for convenient, and comfortable use by the handicapped, disabled, or the elderly.

It is significant that the double angle, recessed configuration of the rotatable wall segments of the self-cleaning restroom additionally define utility spaces which are useful for storage and cabinet space, and which contribute to the spaciousness of the interior of the restroom facility. The restrrom functions substantially as an articulated wall, to which fixtures may be mounted, lending itself to remodelling of existing rooms, as simply as by installation of a major appliance.

This invention having been described in its preferred and alternative embodiments, it is clear that it is susceptible to numerous modifications and embodiments within the ability of those skilled in the art and without the exercise of the inventive faculty. Thus, it should be understood that various changes in form, detail and application of the present invention may be made without departing from the spirit and scope of this invention.

I claim:

1. In a self-cleaning restroom of the type having at least one non-rotatable wall member associated with a fixed toilet and at least one rotatable wall member supporting a restroom fixture and adapted to move between a first position in which said toilet and said fixture are accessible for use and a second position in which said wall members, said toilet and said fixture are nested in close proximity to each other to define a cleaning space for automatic cleaning; means for cleaning said walls, toilet and fixture in their second position with a fluid solution; restroom fixture support means carrying said fixture; means for rotating the fixture support means into said second position; stationary and non-rotatable plumbing means including stationary plumbing lines in fluid communication with said toilet; fixture plumbing means in fluid communication with said fixture and in fluid communication with said stationary plumbing means, including plumbing lines and means for rotating at least a portion of said plumbing lines and means for rotating at least a portion of said plumbing lines with respect to said stationary plumbing lines; and said cleaning means including cleaning lines and means for rotating at least a portion of said cleaning lines with said fixture support means with respect to said stationary plumbing lines, the improvement comprising:

one of said wall members having first and second wall sections formed at right angles to form a non-recess single angle wall member; and at least one other of said wall members having a zigzag double angle configuration, with first, second, and third wall sections, said second wall section being formed at a first right angle to the first wall section, and said third wall section being recessed relative to at least the width of said restroom fixture with respect to said single angle wall member and being formed at a second right angle opposite to said first right angle.

2. The self-cleaning restroom of claim 1, wherein said single angle second wall section has a length greater than said single angle first wall section, and said self-cleaning restroom cleaning space is reduced by said greater length extension of said non-recessed wall member in said second position.

3. The self-cleaning restroom of claim 2, wherein said non-rotatable wall member comprises a single angle wall, and said rotatable wall member comprises a double angle wall which is hinged for rotation into nesting relationship with said non-rotatable wall member.

4. The self-cleaning restroom of claim 1, wherein self-cleaning restroom is enclosed within a main housing wall, and said single angle wall member in combinaton with said double angle recessed wall member provide a utility space between said non-recessed wall member and said main housing wall.

5. The self-cleaning restroom of claim 1, wherein said self-cleaning restroom is juxtaposed to at least one other like self-cleaning restroom, and said single angle wall member and said double angle recessed wall member define a utility space in combination with said at least one other like self-cleaning restroom.

* * * * *